US006088974A

United States Patent [19]

Kloeden, Sr.

[11] Patent Number: 6,088,974

[45] Date of Patent: Jul. 18, 2000

[54] MOBILE COVER FOR SCRAP METAL CONTAINERS

[76] Inventor: Ronald D. Kloeden, Sr., 605 N. 61st St., Wauwatosa, Wis. 53213

[21] Appl. No.: 09/044,515

[22] Filed: Mar. 29, 1998

[51] Int. Cl.[7] ..... E04B 1/12

[52] U.S. Cl. ..... 52/143; 220/730

[58] Field of Search ..... 52/66, 67, 143; 220/730, 731

[56] References Cited

U.S. PATENT DOCUMENTS

| | | | |
|---|---|---|---|
| 2,852,814 | 9/1958 | Bignardi | 52/143 X |
| 4,228,622 | 10/1980 | Tisma | 52/143 X |
| 4,711,257 | 12/1987 | Kobayashi | 52/67 X |
| 4,712,966 | 12/1987 | Gross | 52/143 X |
| 4,986,037 | 1/1991 | Jackson, Jr. | 52/67 |
| 5,201,152 | 4/1993 | Heffner | 52/143 X |
| 5,245,801 | 9/1993 | Boesvert | 52/66 X |
| 5,384,992 | 1/1995 | Roberton | 52/67 |
| 5,447,251 | 9/1995 | Taylor | 220/523 |
| 5,706,971 | 1/1998 | Taylor | 220/523 |

FOREIGN PATENT DOCUMENTS

| | | | |
|---|---|---|---|
| 406257227 | 9/1994 | Japan | 52/143 |

*Primary Examiner*—Richard Chilcot
*Attorney, Agent, or Firm*—Andrus, Sceales, Starke & Sawall

[57] ABSTRACT

A mobile cover for scrap metal containers located in outside areas that are open to the elements, such as snow and rain. The cover includes a waterproof covering material stretched over a framework that is able to substantially enclose the scrap metal container. The cover has wheels allowing the cover to be moved from its covering position over the scrap metal container. With such a cover, rain and snow, as well as other undesirable debris, are prevented from collecting in the bottoms of these types of containers.

9 Claims, 4 Drawing Sheets

FIG. 3
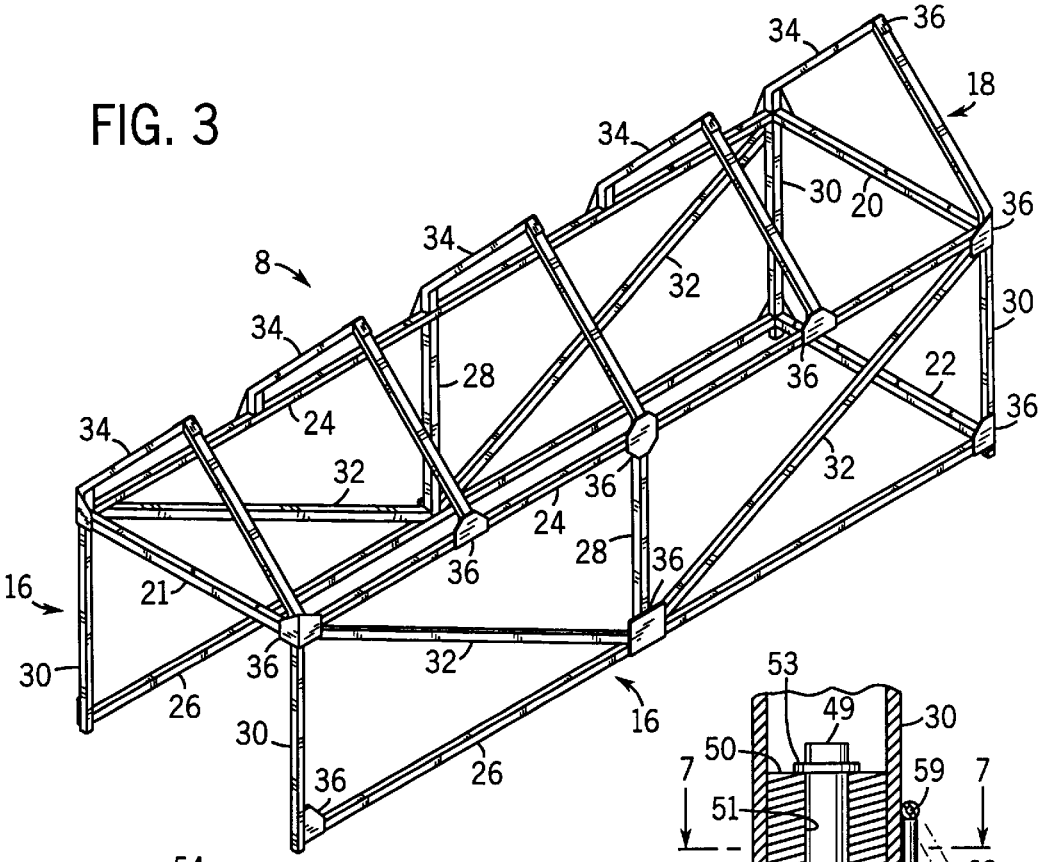
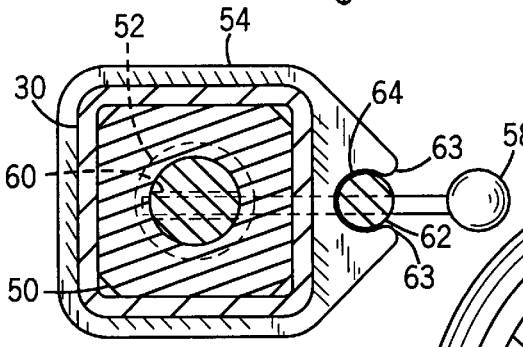
FIG. 7
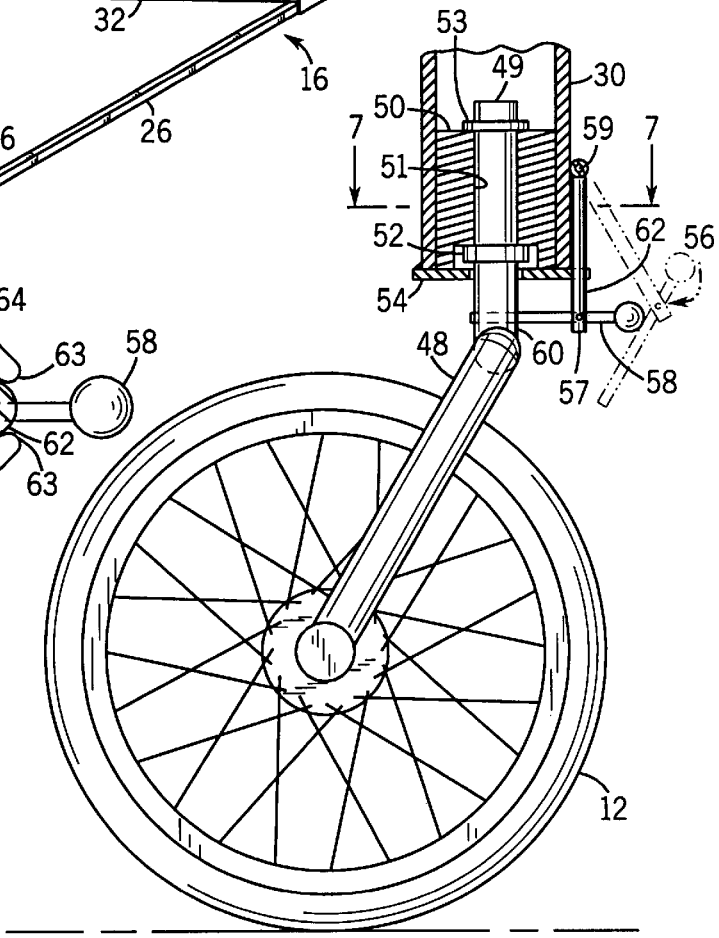
FIG. 6

FIG. 4
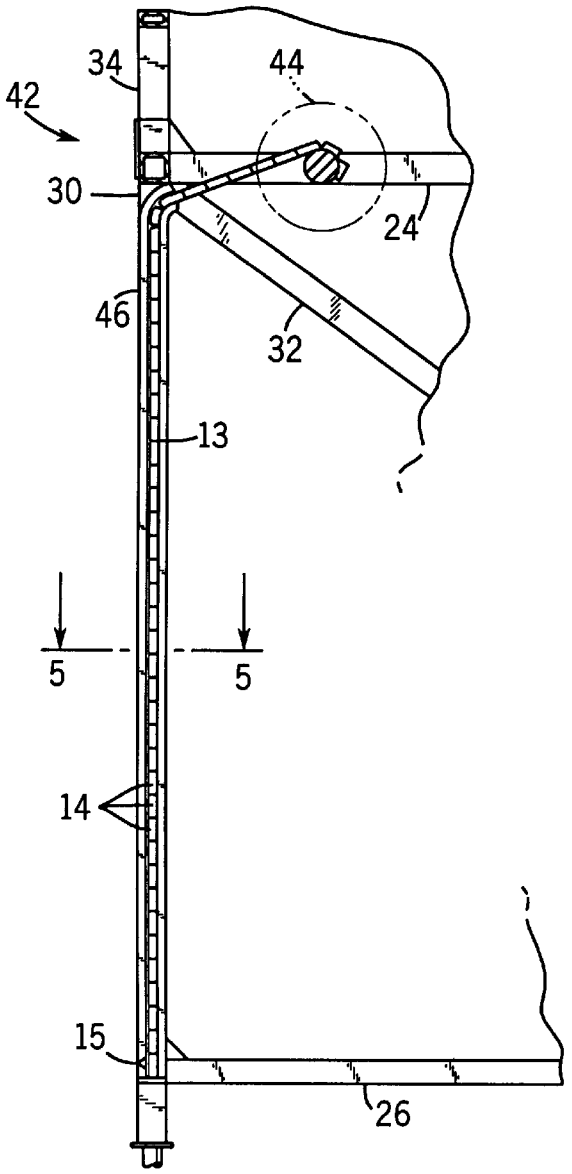
FIG. 8
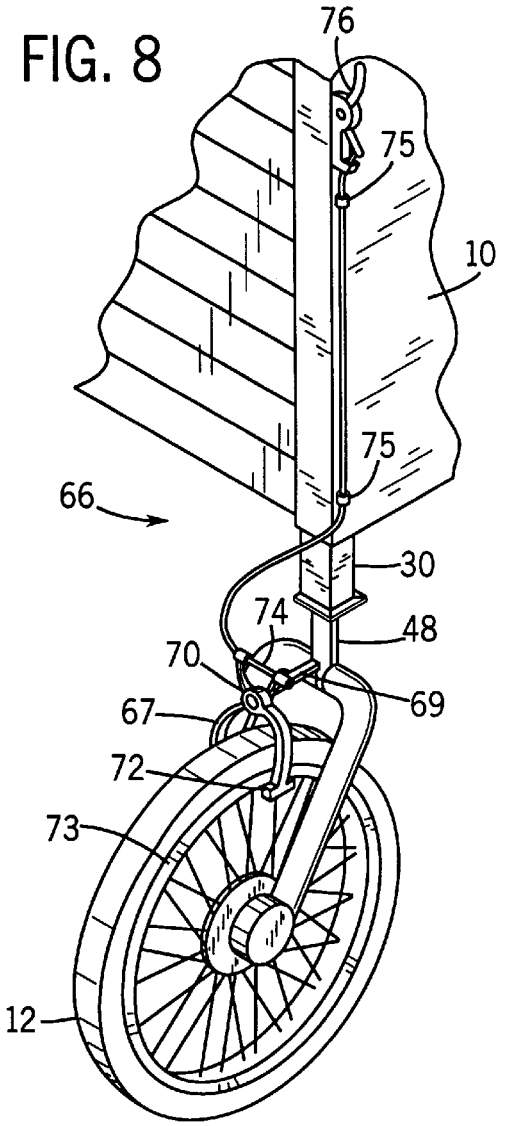
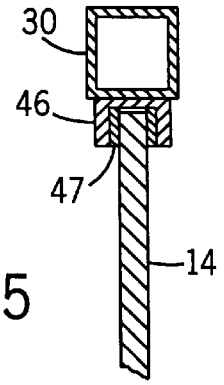
FIG. 5

FIG. 10
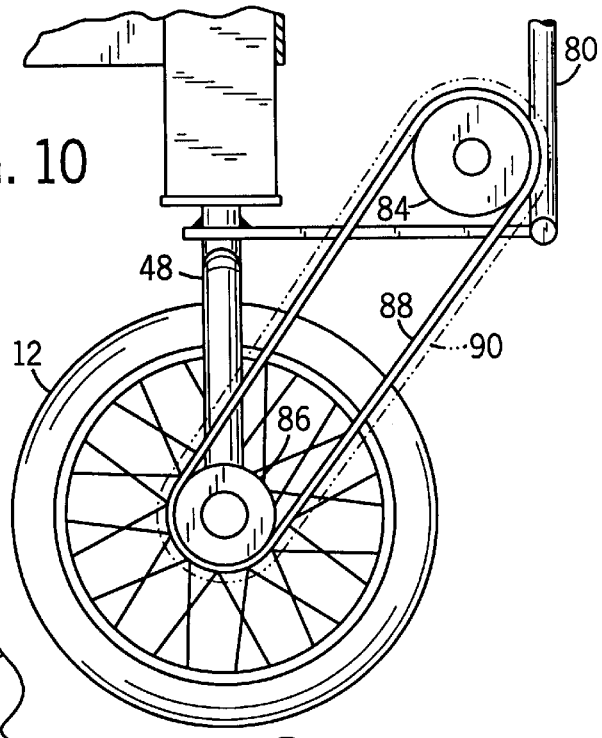
FIG. 9
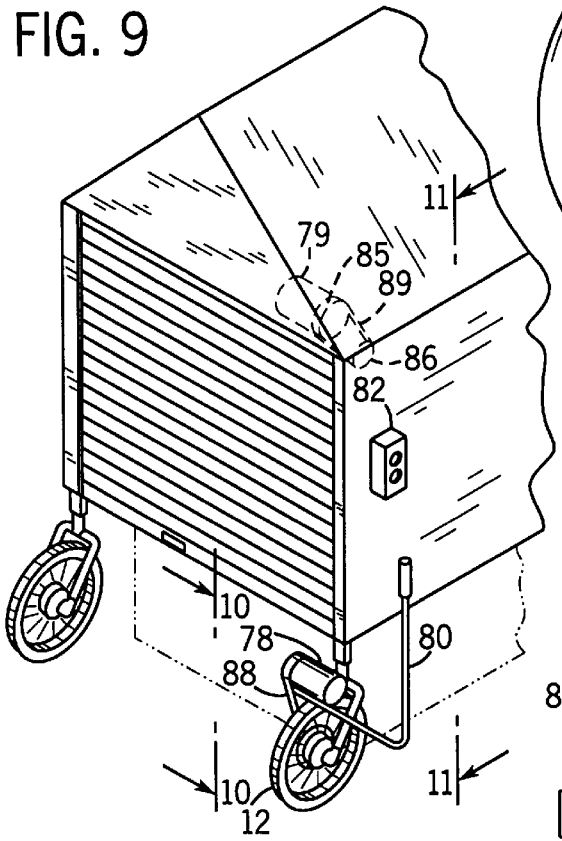
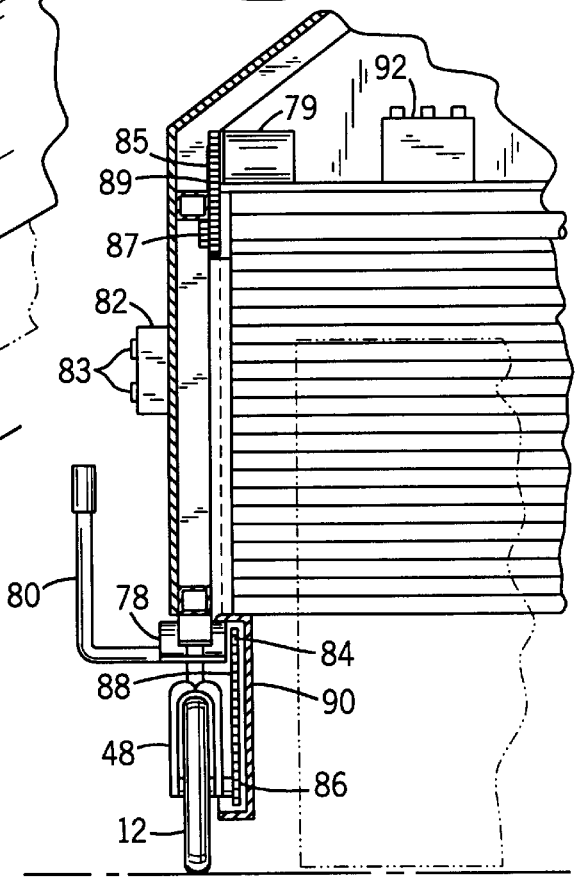
FIG. 11

MOBILE COVER FOR SCRAP METAL CONTAINERS

FIELD OF THE INVENTION

The present invention relates to the scrap metal industry, and more particularly, to an enclosure for containers used to store scrap metal before shipment to a scrap metal yard or recycling center.

BACKGROUND OF THE INVENTION

Large open topped containers, also called load-lugger boxes and roll off boxes, are employed in the scrap metal industry to receive and temporarily store scrap metal generated by various metal working industries before transportation to scrap metal yards or recycling plants. These containers are very large, open top, rectangular shaped structures and normally accommodate about three tons of scrap metal. Due to their size, these containers are typically located outdoors. Being outside, these open containers are exposed to the elements, and as such, tend to collect water from rain or snow. This water combines with the residual cutting and lubricating oils present on the scrap metal, creating a hazardous waste mixture of water and various oils. When time comes for the scrap metal to be dumped at the scrap metal yard, the proper disposition of the water/oil mixture causes numerous monetary and ecological problems. The mixture cannot be summarily dumped without creating a hazard to the environment, and proper disposal incurs an extraneous expense on the party generating the scrap metal.

Various methods have been used to attempt to prevent water from accumulating in these containers and creating the hazardous mixture. One method employed has tarps tied over the tops of the containers. While adequate in initially keeping water out of the container, water still may collect in the container because a tarp will typically sag, allowing water to accumulate or puddle on it, and when the tarp is loosened and removed to allow more scrap metal to be deposited within the container, the water spills off the tarp into the container.

Another method used to stop water accumulation in these containers is to build a small roof over the container itself. This method removes the sagging problem of a tarp, but allows rain and snow to be swept by the wind into the container from either side. Furthermore, cost incurred by the construction of these roofs is very high.

It is an object of the present invention to solve this problem of water accumulation in the scrap metal containers by covering the container in such a way that rain and snow are kept out, but easy access for dumping scrap metal is maintained.

It is another object of this invention to provide a combination of weather protection and easy access at low cost.

BRIEF SUMMARY OF THE INVENTION

The invention is directed to an improved covering for sheltering a load-lugger box or other scrap metal container from rain and snow so as to prevent this rain and snow from mixing with the cutting and lubricating oils present on scrap metal within the container and forming a hazardous substance requiring special disposal methods. The design of the present invention overcomes the limitations of the prior art by providing mechanical simplicity with structural integrity in an effective and low cost embodiment.

In one embodiment of the invention, a mobile cover is provided for sheltering a load-lugger box and its contents from the elements. The cover comprises identical, parallel first and second side walls made of a framework of interconnecting beam members and a top or roof also made of a framework of interconnecting beam members that connects to each side wall forming an enclosure of sufficient height, width and is length to substantially surround and encompass a filled load-lugger box. A water resistant material covering is placed over the side walls and roof formed by the frameworks and is secured thereto by any suitable means such as a bungee cord or other securing mechanism. Wheels are located at both the front and rear ends of each side wall to support the frameworks and facilitate movement of the mobile cover from a covering position over the load-lugger box to an uncovering position away from the load-lugger box. The mobile cover also contains at one end a protective curtain and curtain displacement mechanism which enables the curtain to be moved between an open position aid a closed position. When closed, the curtain prevents wind-driven rain or snow from entering the container. When open, this mechanism allows movement of the mobile cover from its covering position to its uncovering position without the curtain snagging on the container or the scrap metal therein.

In another embodiment of the invention, the curtain may be displaced manually, and may, for example, include a set of rings inserted through holes in the upper end of the protective curtain and secured around a horizontal rod at one end of the mobile cover. This mechanism forms a shower curtain-like arrangement wherein the curtain can be displaced to one side by manually sliding the rings and the curtain along the rod.

In yet another embodiment of the invention, a drive motor can be attached to one or more of the wheels to create a motorized drive mechanism for the cover. Also, a drive motor can be attached to the curtain displacement mechanism allowing for a mechanized method for moving the curtain. These drive motors can be controlled using an on-off push button control box located on the exterior of one of the side walls. This push button control box may be connected to a battery placed within the framework of the mobile cover that supplies the power to the drive motors, or via a cord to a more permanent source of electric power.

In still another aspect of the invention, these drive motors can be actuated through the use of a remote control mechanism connected to the drive motors.

BRIEF DESCRIPTION OF THE SEVERAL VIEWS OF THE DRAWING

The drawings furnished herewith illustrate a preferred construction of the present invention in which the above advantages and features are clearly disclosed as well as others which will be readily understood from the following description of the illustrated embodiment.

FIG. 3 is a perspective view of the interior framework of the mobile cover and the connections between its individual parts;

FIG. 4 is a fragmentary cross-sectional view taken along line 4—4 of FIG. 1;

FIG. 5 is a fragmentary cross-sectional view taken along line 5—5 of FIG. 4;

FIG. 6 is a side elevational view of the attachment of a wheel and a wheel lock to the framework of the mobile cover;

FIG. 7 is a cross-sectional view taken along line 7—7 of FIG. 6;

FIG. 8 is a fragmentary perspective view of a caliper braking mechanism for one of the wheels of the mobile cover;

FIG. 9 is a fragmentary perspective view of a second embodiment of the present invention illustrating the front end of the mobile cover and showing a motorized version of the mobile cover with a steering rod;

FIG. 10 is a fragmentary cross-sectional view taken along line 10—10 of FIG. 9; and FIG. 11 is a fragmentary cross-sectional view taken along line 11—11 of FIG. 9.

DETAILED DESCRIPTION OF THE INVENTION

Figure 1:
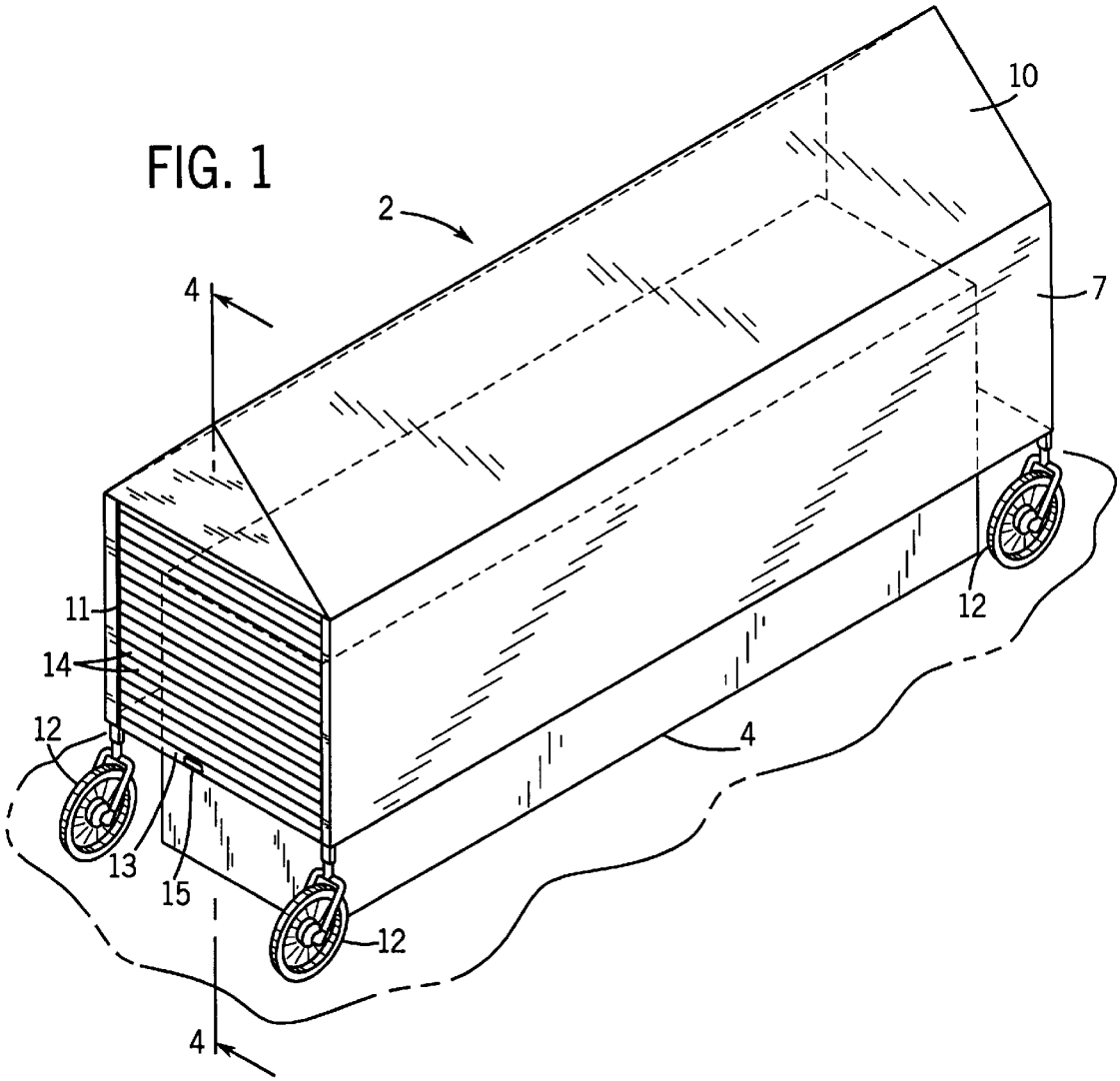
FIG. 1 is a perspective view of a mobile cover for a scrap metal container made pursuant to the present invention, shown covering a container of that type.
Figure 2:
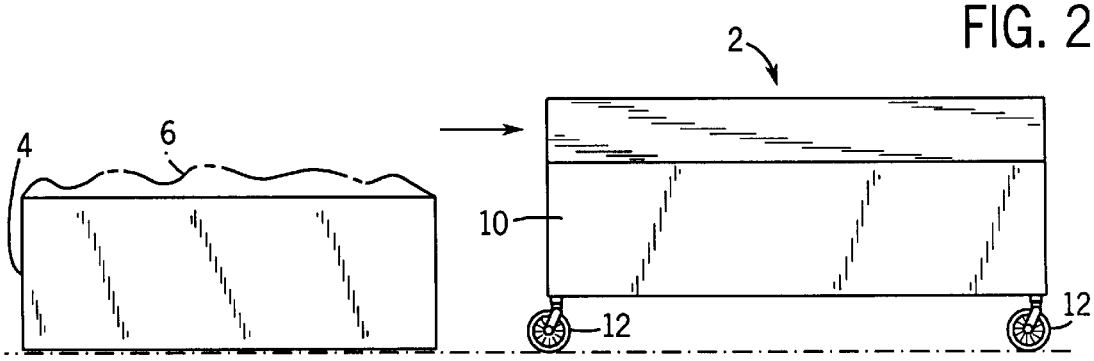
FIG. 2 is a side elevational view illustrating the mobile cover moved to its uncovering position to expose the scrap metal container.

FIG. 1 shows a mobile cover generally designated by the numeral 2 made pursuant to the present invention in a covering position over a scrap metal container 4, and FIG. 2 shows the mobile cover 2 moved to its uncovering position to expose scrap material 6 and enable access to container 4. The mobile cover 2 is comprised generally of a rigid framework 8 (see FIG. 3), a set of wheels 12 attached to opposite ends of the framework 8, a covering material 10 draped over the top, rear end and both sides of the framework 8, and a curtain 13 disposed at one end of the framework 8. The length, height and width dimensions of mobile cover 2 are slightly greater than the corresponding dimensions of the scrap metal container 4 it encloses, thus allowing the mobile coffer 2 to substantially surround and enclose a scrap metal container 4 as shown in FIG. 1. This prevents rain or snow from falling into, or from being driven into by wind, the open top of container 4, yet provides sufficient spacing from container 4 to permit removal of cover 2 when necessary.

The covering material 10 shown in FIG. 1 is a waterproof material, such as canvas or a plastic sheet, that is flexible enough to closely conform to and be stretched over the shape of framework 8. The material 10 is fastened to the framework 8 by rivets (riot shown) driven through the material 10 into the framework 8. Other fastening means such as straps, cords, hooks, etc. may also be used to hold material 10 in place. The material 10 is fastened to the framework 8 near the bottom of both sides of the framework 8, at a level below the height of the open top of scrap metal container 4 to prevent rain and snow from blowing sideways into scrap metal container 4. The covering material 10 also encloses the rear end of container 4, as at 7, and has an opening 11 located at the front end of the framework 8 to accommodate the curtain 13.

FIG. 3 illustrates the structure of the framework 8 that forms the enclosure and supports material 10 of the mobile cover 2. The framework 8 includes two identical, parallel side walls 16 joined by a top or roof 18. Each wall 16 comprises an upper support beam 24 and a lower support beam 26 that both extend horizontally the entire length of walls 16. The upper support beam 24 and lower support beam 26 are joined together by a vertical center support beam 28 extending midway between upper and lower support beams 24 and 26, a pair of vertical front and rear end support beams 30 extending from the upper support beam 24 to below the lower support beam 26 and located at opposite ends of beams 24 and 26, and a pair of angled bracing beams 32 extending from the lower end of center support beam 28 to the upper end of each end support beam 30. The two side walls 16 are joined by a top or roof 18 comprised of a set of inverted V-shaped joists 34, one attached at each end of the upper support beams 24 and three evenly spaced along the length of the beams 24. The two side walls 16 are also interconnected by an upper cross beam 20 extending between the upper ends of the end support beams 30 and a lower cross beam 22 extending between the lower ends of the end support beams 30 to form a closed rear end for framework 8. At the opposite end of framework 8, an upper cross beam 21 joins the upper end of end support beams 30 but there is no corresponding lower cross beam thus forming an open front end or curtain opening 11 for framework 8. The individual components of the side walls 16, the top or roof 18, and the overall framework 8 are joined together by mounting brackets 36 that contain slots (not shown) for insertion of mounting bolts (not shown) to secure the individual members of the framework 8 together.

FIGS. 4 and 5 illustrate the structure of the curtain 13 and a curtain displacement mechanism 42 located at the front end of mobile cover 2. The curtain 13 is comprised of individual slats 14 connected in succession in a well known and conventional hinge-like manner allowing the curtain 13 to bend between each individual slat 14 when opening or closing. The curtain displacement mechanism 42 is comprised of U-shaped tracks 46 located or the interior edges of each end support beam 30, as shown in FIG. 5, and a roller 44 disposed between the upper support beams 24 of the side walls 16, as shown in FIG. 4. The topmost curtain slat 14 is fixedly attached to the roller 44, allowing the roller 44 to take up or collect the individual slats 14 of the curtain 13 when the roller 44 is rotated in a clockwise direction or to play out or unroll the curtain when rotated counterclockwise. The curtain tracks 46 capture and guide the edges of slats 14 vertically down the end support beams 30, and the inner surface of tracks 46 contain a sheet-like material 47 such as nylon to reduce friction and provide ease of sliding movement for curtain 13. The curtain 13 is manually displaced upwardly to open the front end of mobile cover 2 through the use of a handle 15 located on the lowermost curtain slat 14. When this curtain handle 15 is grasped and pushed upward, the individual slats 14 wrap around the roller 44 as the curtain 13 is moved from its downward, closed position to its upward, open position.

FIGS. 6 and 7 illustrate the attachment of a wheel 12 to an end support beam 30. The assembly is similar to a caster and enables 360° movement for wheel 12 by mounting wheel 12 in a swivel frame or fork 48. Fork 48 includes an upper rotatable shaft 49 which is inserted through an opening 51 in a wheel mounting block 50 until a flange 52 abuts against one end of block 50. The wheel fork shaft 49 is secured on the other side of the wheel mounting block 50 by a spring loaded locking washer 53. The wheel mounting block 50 is inserted within the hollow bottom of end support beam 30 and retained therein by mounting plate 54 pressed flush against the lower end of the end support beam 30 and welded thereto.

To prevent wheels 12 from rotating at undesirable times, a wheel lock 56 is attached to the exterior of end support beam 30. The wheel lock 56 is comprised of a locking pin 58 which slides into a locking slot 60 located within shaft 49 of wheel fork 48, and a bar 62 hinged to the locking pin 58 at 57 and to the end support beam 30 at 59. When in use, the locking pin 58 of wheel lock 56 is held in position within the locking slot 60 by a detent 64 located on the wheel mounting plate 54 as shown in FIG. 7. Detent 64 is formed by a pair of outwardly extending fingers 63 on the wheel mounting plate 54 that engage and secure the bar 62 when the locking pin 58 is inserted into the locking slot 60. Detent 64 securely holds the bar 62 of wheel lock 56, but the bar 62 can be manually removed from the clip 64 by pulling with sufficient force to disengage bar 62 therefrom.

A braking mechanism 66 employed to prevent wheels 12 from rotating, thereby preventing the mobile cover 2 from moving, is shown in FIG. 8. The braking mechanism 66 is comprised of a pair of caliper arms 67 and 68 disposed one on either side of the wheel 12. Each caliper arm 68, 67 contains a brake pad 72 used to engage the wheel rim 73 to hold the wheel 12 in a stationary position. The caliper arms 67, 68 criss-cross and are pivotally interconnected by a pin 69 to the wheel fork 48 on the side opposite from that of wheel lock 56. A torsion spring 70 is located about the pivot pin 69 and biases the brake pads 72 located on the caliper arms 67, 68 out of engagement with the wheel rim 73. The upper ends of the caliper arms 67, 68 are connected by a brake release cable 74 that includes a wire slidably movable within a sheath or jacket. At its lower end, the brake release cable 74 is attached between the upper ends of caliper arms 67, 68 so that the wire is secured to caliper arm 67 and the sheath or jacket is secured to caliper arm 68. The upper end of the brake release cable 74 is connected to a brake release lever 76, that is pivotally attached to the exterior of the mobile cover 2. The sheath or jacket of brake release cable 74 is secured to the exterior of the mobile cover 2 along its length between the brake release lever 76 and the caliper arms 67, 68 by securing clips 75. Normally, the wheel 12 may rotate to allow mobile cover 2 to move since pads 72 are held out of engagement with rims 73. However, when the brake release lever 76 is pivoted upwardly, i.e. in a counterclockwise direction, the brake release cable 74 pulls the upper ends of the caliper arms 67, 68 towards each other, applying the brake pads 72 against the wheel rim 73 to prevent the wheel 12 from turning, and thus hold mobile cover 2 in any desired location. More particular, when the curtain 13 is retracted through the use of the curtain displacement mechanism 42 as shown in FIGS. 4 and 5 and the braking mechanism 66 as shown in FIG. 8 is deactivated through use of the brake release lever 76, the mobile cover 2 can be moved from its covering position over a scrap metal container 4 as shown in FIG. 1 to its uncovering position as shown in FIG. 2.

FIGS. 9–11 illustrate a second embodiment of the mobile cover 2 wherein the mobile cover 2 and curtain 13 are displaced by powered mechanical means rather than manual means. In FIGS. 9 and 11, respective drive motors 78, 79 are attached to one wheel 12 and to the roller 44 of the curtain displacement mechanism 42. The drive motors 78, 79 are connected by drive shafts (not shown) to power gears 84, 85 respectively. The wheel 12 and roller 44 each are connected to a motion gear 86, 87 that are driven by drive chains 88, 89 which are connected between the power gears 84, 85 and motion gears 86, 87. The power for the drive motors 78, 79 is supplied by a battery 92 located within the framework 8 of the mobile cover 2 as shown in FIG. 11. The power from the battery 92 is connected to the drive motors 78, 79 through a control box 82 located on the exterior of the mobile cover 2. This control box 82 has a pair of on-off switches 83 that selectively open and close the circuit between the battery 92 and the drive motors 78, 79, allowing for the drive motors 78, 79 to be selectively activated and deactivated using the switches 83. The drive motor 78 for the wheel 12 further comprises a drive chain cover 90 enclosing the drive chain 88 on the interior of the mobile cover 2. The drive motor 78 for the wheel 12 also includes a steering rod 80 extending outward and upward from the drive chain cover 90. This steering rod 80 allows an operator to control the direction in which the mobile cover 2 moves when the drive motor 78 for the wheel 12 is activated.

Various modes of carrying out the invention are contemplated as being within the scope of the following claims particularly pointing out and distinctly claiming the subject matter which is regarded as the invention.

I claim:

1. In combination, a scrap metal container having an open top, and a mobile cover for said container used to shelter the container and prevent rain and snow from collecting in the container, the mobile cover comprising:

an interconnected framework with a height, length and width slightly greater than the corresponding dimensions of the scrap metal container box including a pair of opposed side walls, a roof connecting the side walls, an end wall extending between the side walls beneath the roof, and an open end opposite the end wall, the side walls and end wall extending to a level substantially below the open top of the container;

a waterproof material covering said framework and supported by said walls and roof;

a curtain disposed at the open end of said framework movable from an open position to a closed position, curtain being coextensive with the adjacent side walls and enclosing the container in the closed position and exposing one end of the container in the open position; and a means for moving the cover from a covering position substantially enclosing said container to an uncovering position which provides access to the open top of said container.

2. The combination of claim 1 wherein the moving means includes at least one wheel located at the lower end of the interconnected framework.

3. The combination of claim 2 further including a braking means attached to at least one wheel to selectively brake the wheel and prevent movement of the mobile cover.

4. The combination of claim 1 wherein the covering material is comprised of a waterproof plastic material.

5. The combination of claim 2 further including a drive motor connected to said at least one wheel to mechanically rotate the wheels and move the cover between said covering position and said uncovering position.

6. The combination of claim 1 further including a drive motor connected to the curtain to mechanically displace the curtain between a closed position and an open position.

7. The combination of claim 5 wherein the drive motor is activated by a push button control box located on the exterior of the mobile cover.

8. The combination of claim 5 wherein the drive motor is activated by a remote control mechanism.

9. The combination of claim 2 further including means for steering said at least one wheel.

* * * * *